United States Patent [19]

Hoffman

[11] 4,119,174

[45] Oct. 10, 1978

[54] ENGINE MUFFLER

[75] Inventor: Edward Hugo Hoffman, Simi Valley, Calif.

[73] Assignee: Skyway Recreation Products, Redding, Calif.

[21] Appl. No.: 799,120

[22] Filed: May 20, 1977

[51] Int. Cl.[2] ..... F01N 3/06; F01N 1/08; F01N 3/04

[52] U.S. Cl. ..... 181/231; 181/265; 181/272

[58] Field of Search ..... 181/265, 272, 275, 230, 181/231; 55/276

[56] References Cited

U.S. PATENT DOCUMENTS

| | | | |
|---|---|---|---|
| 2,655,220 | 10/1953 | Tyskewicz | 181/265 |
| 3,771,315 | 11/1973 | Scott | 181/265 X |
| 3,827,531 | 8/1974 | Hansen | 181/265 |
| 3,987,867 | 10/1976 | Moller | 181/231 |
| 4,056,934 | 11/1977 | Mizusawa | 181/265 X |

*Primary Examiner*—Donald G. Kelly
*Attorney, Agent, or Firm*—Lindenberg, Freilich, Hornbaker, Wasserman, Rosen & Fernandez

[57] ABSTRACT

An engine muffler which includes a chamber divided into two balanced sections, an inlet pipe that extends through a first chamber into the second, and a transfer tube for carrying exhaust gas from the second chamber to the first. A spark arrester at the exit end of the muffler includes a plurality of slightly spaced plates that permit the outflow of gas but not of large carbon particles, and a closed dish-shaped end plate for receiving the carbon particles.

4 Claims, 9 Drawing Figures

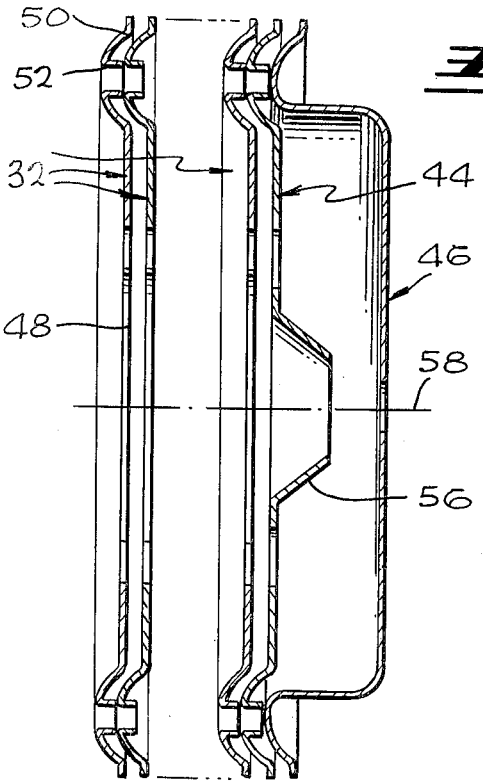
Fig. 6
Fig. 7
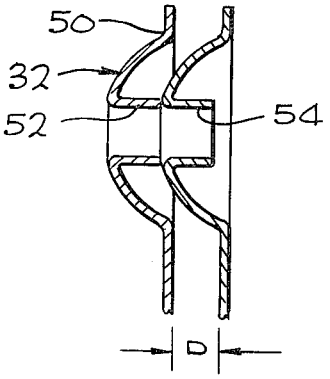
Fig. 8
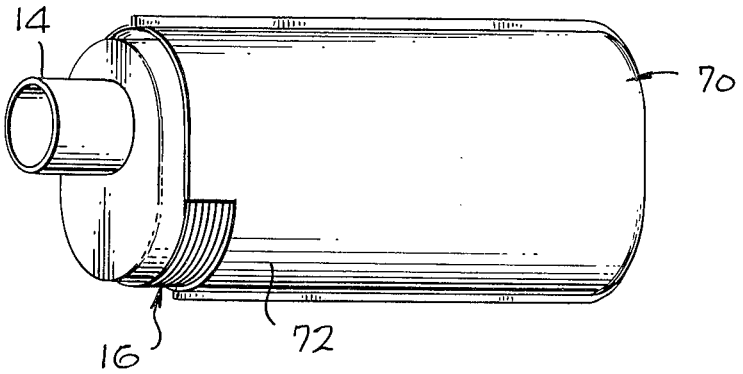
Fig. 9
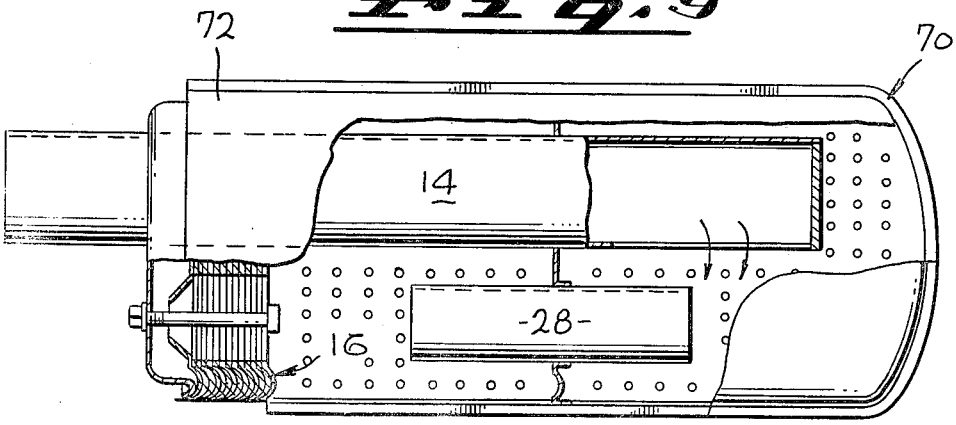

ENGINE MUFFLER

BACKGROUND OF THE INVENTION

This invention relates to mufflers for engines.

Engine mufflers, especially those for motorcycles, must be compact and yet produce minimal noise. Such mufflers typically must include spark arresters to prevent the emission of hot carbon particles that could start fires. Of course, the carbon particles that are trapped will accumulate, and the spark arrester must be occasionally cleaned. A compact and efficient muffler and an efficient and easily cleaned spark arrester would have great utility.

SUMMARY OF THE INVENTION

In accordance with one embodiment of the present invention, a compact and economical muffler assembly is provided, which efficiently absorbs sound and which has a spark arrester which efficiently traps particles while providing minimal obstruction to the exit of exhaust gases. The muffler includes a housing divided into two chambers, a first pipe extending from the engine exhaust through the first chamber into the second, and a transfer tube extending from the second chamber to the first. In one muffler, a third pipe extends from the first chamber through the second and into a spark arrester. The spark arrester includes a stack of many closely spaced plates, with a hole in the middle of the stack. The spark arrester allows exhaust gases to pass through the narrow spaces between plates, while carbon particles are prevented from doing so. A cap at the end of the stack receives the carbon particles. The plates can be easily formed by stamping, to provide ridges that slightly separate the plates.

The novel features of the invention are set forth with particularity in the appended claims. The invention will be best understood from the following description when read in conjunction with the accompanying drawings.

BRIEF DESCRIPTION OF THE DRAWINGS

FIG. 6 is a partial sectional side view of the spark arrester portion of the muffler of FIG. 1;

FIG. 7 is a view of a portion of FIG. 6;

FIG. 8 is a perspective view of a muffler constructed in accordance with another embodiment of the invention; and FIG. 9 is a sectional side view of the muffler of FIG. 8.

DESCRIPTION OF THE PREFERRED EMBODIMENTS

Figure 1:
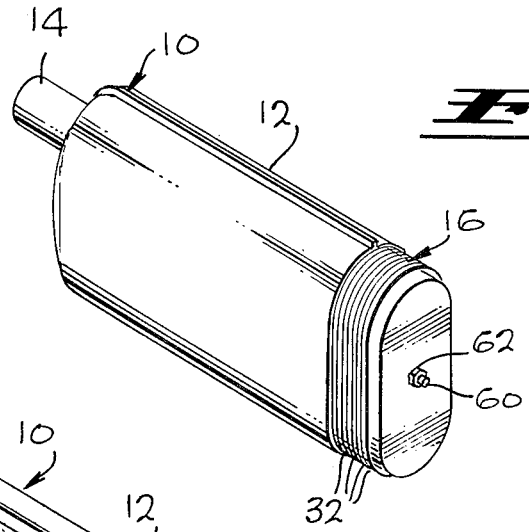
FIG. 1 is a perspective view of a muffler constructed in accordance with one embodiment of the present invention.
Figure 2:
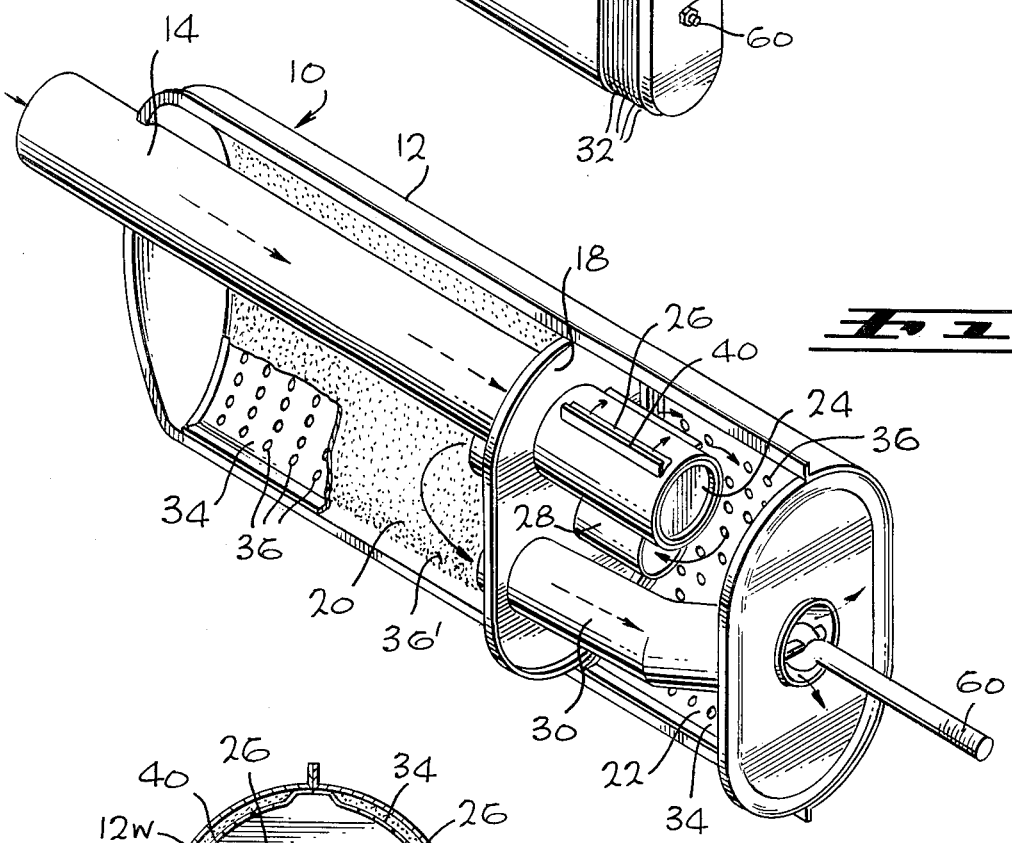
FIG. 2 is a partial perspective sectional view of the muffler of FIG. 1.
Figure 4:
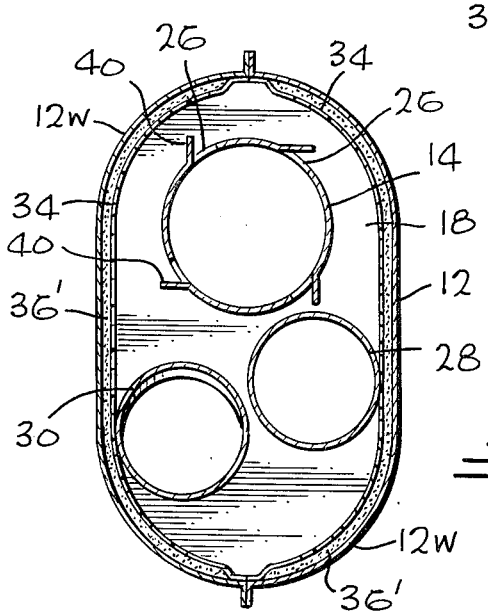
FIG. 4 is a view taken on the line 4—4 of FIG. 3.
Figure 3:
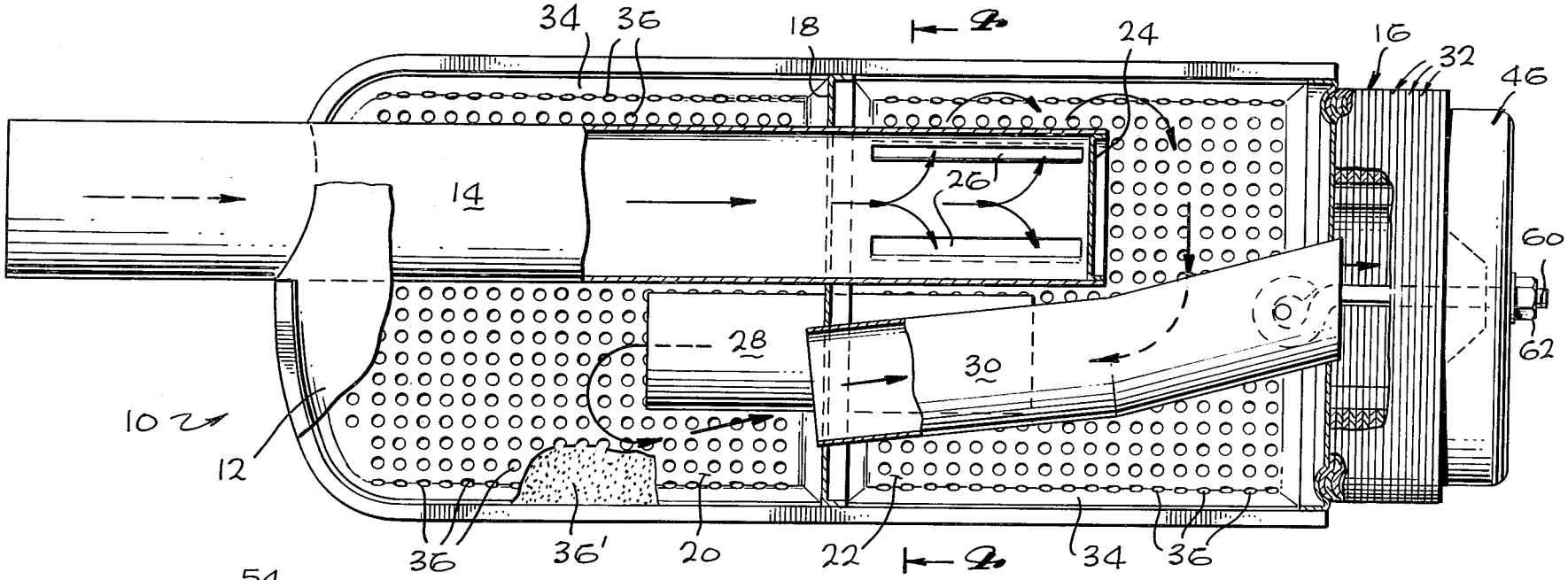
FIG. 3 is a sectional side view of the muffler of FIG. 1.

FIG. 1 illustrates a muffler 10 which includes a housing 12, a first pipe 14 at its front end for connection to the exhaust pipe of a motorcycle engine, and a spark arrester 16 at its rearward end. As also shown in FIGS. 2–4, the housing 12 includes a dividing wall 18 that divides the enclosed volume of the housing into two balanced chambers 20, 22. The first pipe 14 extends from the front of the housing through the first chamber 20 and into the second chamber 22. The extreme end of the first pipe is closed by an end wall 24 (FIG. 2), but the portion of the end pipe within the second chamber 22 has a series of openings 26 through which exhaust gases flow into the second chamber. The muffler also includes a second pipe or transfer tube 28 that carries exhaust gases from the second chamber 22 back to the first chamber 20, and a third pipe 30 that carries exhaust gases from the first chamber 20 through the second chamber 22 and into the spark arrester 16 (FIG. 2). The spark arrester 16 includes a series of about a dozen plates 32 arranged in a stack, but with the plates slightly spaced apart to permit the escape of exhaust gases therefrom.

The inside surface of the housing 12 is covered by sheets 34 having numerous holes 36 therethrough, and with most of the sheet areas spaced from the outer wall 12*w* of the housing. Insulator sheets 36 of sound absorbing material, such as ceramic fiber which can withstand high temperatures, are positioned under the perforated sheets 34. The perforated sheets permit considerable sound to pass therethrough so that such sound can be absorbed by the insulator sheets 36, to reduce noise.

The three pipes 14, 28, 30 of the muffler provide a long and convoluted path through which the exhaust gases pass. Gas first enters the tube 14, which is made long without unduly extending the length of the muffler, by allowing this tube to pass through the first chamber 20 of the muffler. The use of a closed end 24 of this tube allows shock wave to be reflected from the wall 24, while allowing exhaust gases to pass through the openings 26. The openings are punched from the tube 18 so as to leave deflectors 40 extending at less than 90° to the tube surface, that deflect the exiting gases so that they swirl about the tube 14. This increases the convolusion of the path, to absorb energy in the gases and therefore to reduce noise.

The transfer tube 28 which extends between the chambers 20, 22 to carry exhaust gases between them, serves to further elongate the path of the exhaust gases, as compared to a simple hole in the divider 18. In addition, the tube 28 can serve as a filter that tends to filter out noise of a particular frequency that is present in the greatest amplitude. For a relatively small engine, of a cylinder displacement of 125 cubic centimeters, a transfer tube length of approximately four inches has been found desireable to minimize the amount of noise emitted by the muffler. For a large engine, such as of a displacement of 400 cubic centimeters, a tube length of one inch has been found most useful for filtering out the greatest amount of noise. For engine sizes between 125 cc and 400 cc, a length between one inch and four inches should be used. Thus, mufflers for different engines can be constructed of the same parts, except for the use of transfer tubes of different lengths.

Figure 5:
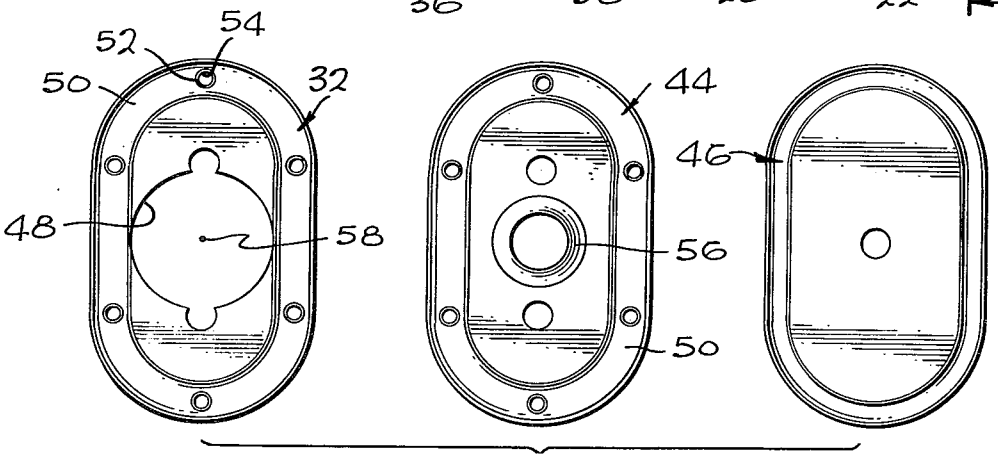
FIG. 5 is a front elevation view of three of the plates of the spark arrester portion of the muffler of FIG. 1.

The spark arrester includes three types of plates (FIG. 5) 32, 44, 46. One spark arrester for a relatively small engine (e.g. 125 cc) includes a stack of 10 main plates 32, a transition plate 44 over the rearward end of the stack, and a cap plate 46 over the transition plate. The main plates 32 have central holes 48 aligned with each other and with the rearward end of the third pipe 30, to receive exhaust gases. The plates are spaced apart by a small distance D of about 0.025 inch, to prevent the exit of all but the very smallest particles, while permitting the escape of exhaust gases.

Each main plate 32 is constructed of sheet metal formed with a rounded peripheral portion 50, and with several protuberances 52 (FIG. 7). Each of the protuberances 52 is formed by punching a hole 54 in the plate in a manner that leaves a protuberating region around the hole. When the plates are stacked on one another, the protuberances 52 cause the plates to be spaced a small distance apart at all regions. (except at the protuberances). For plates with central holes 48 of about 1½ inches in diameter, and for plates spaced 0.025 inch apart, there is an exit cross-sectional area of about one-tenth square inch between plates and therefore, about one square inch exit area for a stack of 10 plates.

The cap plate 46 is in the form of a deep dish, and serves to receive and hold carbon particles. The transition plate 44 has a funnel-shaped center portion 56 that facilitates the entry of carbon particles into the cap plate 46 while resisting the escape of such particles therefrom. Since the exhaust initially moves along the axis 58 of the stack of plates, the carbon particles tend to be propelled into the cap plate 46, where they remain until the spark arrester device is cleaned.

The curved peripheries 50 of the plates have been found to reduce the sound emitted by the muffler and to reduce the back pressure produced by the muffler on the engine. Stacks of plates have been constructed both with and without the curved peripheral portions, and tests were made to determine the back pressure and noise levels produced by the mufflers. The use of plates with curved peripheries were found to produce lower back pressures and lower external noise levels. The curved peripheries direct exhaust gases rearwardly with respect to motorcycle movement.

The stack of plates of the spark arrester is held together, and is held to the rearward end of the muffler, by an eyebolt 60 (FIG. 3) that passes along the axis 58 of the stack, and by a nut 62 which is screwed onto the end of the bolt. The spark arrester 16 can be easily disassembled for cleaning, by removing the nut 62 and taking off the stack of plates. After cleaning, the stack of plates can be easily reassembled, since all of the main plates 32 are identical.

FIGS. 8 and 9 illustrate a muffler 70 of another design, wherein the spark arrester device 16 is located at the front of the muffler where the front of the first pipe 14 is located. In this muffler, there is no third pipe, but only the first pipe 14 and the transfer pipe 28 (FIG. 9). Also, the housing 72 of the muffler extends around the spark arrester 16, except at the lower portion thereof, to prevent the hot exhaust gases from being directed up at the rider. The front of the housing 72 is larger than the outer diameter of the plates of the spark arrester 16, so that the housing does not block off the escape of exhaust gases from the upper portion of the stack of plates.

Thus the invention provides a compact and efficient engine muffler. A relatively long exhaust gas path is provided by dividing the enclosed muffler space into two chambers, and by extending a first pipe through the first chamber. The inside walls of the chambers include perforated sheet metal under which lies sound absorbing material. A transfer pipe, which connects the two chambers of the muffler, is utilized instead of a mere opening between the chambers, to decrease the intensity of the shock wave, which helps filter out noise from the engine. A spark arrester is constructed of a group of plates that can be easily assembled into a stack, wherein the plates are slightly spaced apart to permit the escape of exhaust gases while preventing the escape of large particles.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. An engine exhaust muffler assembly comprising:

a housing forming an enclosed volume and having a dividing wall dividing said volume into first and second chambers;

a first pipe extending through said first chamber, said pipe having a first end for receiving exhaust gases located outside said housing and a second end lying in said second chamber;

a second pipe extending through said dividing wall, with one end in said first chamber and the other end in said second chamber; and means for coupling said first chamber to a region outside the enclosed volume of said housing:

said second end of said first pipe is closed at its extreme end, and the first pipe portion which lies within said second chamber has at least one side opening in the side of said pipe and a deflector beside said side opening which directs gas exiting from said opening in a direction to spiral about said first pipe.

2. The muffler described in claim 1 including:

a layer of heat insulating material lining most of the surface of said chambers, and a thin sheet of metal having numerous holes lying immediately inside said insulating material.

3. In a muffler assembly which includes a muffler, the improvement of a spark arrester connected to said muffler comprising:

a plurality of plates arranged in a stack with the plates having communicating holes near their centers and having peripheral portions slightly spaced apart; and means for applying exhaust gases to said communicating holes;

said plates having holes near but spaced from their peripheries, said holes being formed so the regions of said holes are deformed to form protuberances, and the protuberances of each plate lie against the deformed regions surrounding the holes of an adjacent plate, to thereby space the plates and hold them in alignment.

4. The muffler assembly described in claim 3 wherein:

said plates are non-circular, are identical, and are all in the same rotational position along the axis of the stack.

* * * * *